US008890643B2

(12) United States Patent
Kim

(10) Patent No.: US 8,890,643 B2
(45) Date of Patent: Nov. 18, 2014

(54) HEAT EXCHANGE TYPE COOLING APPARATUS FOR A TRANSFORMER

(71) Applicant: Gap-Dong Kim, Busan (KR)

(72) Inventor: Gap-Dong Kim, Busan (KR)

( * ) Notice: Subject to any disclaimer, the term of this patent is extended or adjusted under 35 U.S.C. 154(b) by 0 days.

(21) Appl. No.: 14/014,466

(22) Filed: Aug. 30, 2013

(65) Prior Publication Data

US 2014/0197912 A1 Jul. 17, 2014

(30) Foreign Application Priority Data

Jan. 16, 2013 (KR) ..... 10-2013-0005018

(51) Int. Cl.
*H01F 27/10* (2006.01)

(52) U.S. Cl.
USPC ..... 336/57

(58) Field of Classification Search
USPC ..... 336/55–62
See application file for complete search history.

(56) References Cited

U.S. PATENT DOCUMENTS

2008/0314077 A1* 12/2008 Rim ..... 62/513
2013/0307654 A1* 11/2013 Hyde et al. ..... 336/60

FOREIGN PATENT DOCUMENTS

KR 20-2004-0035075 Y1 3/2005
KR 1020050108508 A 11/2005
KR 1020070075970 A 7/2007

OTHER PUBLICATIONS

Korean Office Action issued in corresponding Korean Application No. 10-2013-0005018 mailed Apr. 6, 2013.
Korean Office Action issued in corresponding Korean Application No. 10-2012-0113313 mailed on Mar. 30, 2013.
Korean Office Action issued in corresponding Korean Application No. 10-2012-0113317 mailed Dec. 29, 2012.

* cited by examiner

*Primary Examiner* — Tuyen Nguyen
(74) *Attorney, Agent, or Firm* — Davis & Bujold, PLLC; Michael J. Bujold

(57) ABSTRACT

Disclosed herein is a heat exchange type cooling apparatus for a transformer, including: an insulating oil circulation pipe configured in a closed circuit form so that an insulating oil filled in the transformer is discharged to the outside and then returns again to the transformer; an insulating oil pump configured to transfer the insulating oil; and an insulating oil cooling system configured to cool the insulating oil, wherein the insulating oil cooling system includes: a liquid refrigerant maintained in a liquid state during the entire circulation cycle; a refrigerant circulation pipe configured to circulate the liquid refrigerant; a refrigerant pump configured to transfer the liquid refrigerant; and a heat exchanging part configured to heat-exchange the liquid refrigerant and the insulating oil with each other to cool the insulating oil.

12 Claims, 5 Drawing Sheets

HEAT EXCHANGE TYPE COOLING APPARATUS FOR A TRANSFORMER

CROSS REFERENCE TO RELATED APPLICATION

The present disclosure relates to subject matter contained in priority Korean Applications No. 10-2013-0005018, filed on Jan. 16, 2013, the entire contents of which are hereby incorporated by references in their entirety.

BACKGROUND

1. Field

The present disclosure relates to a heat exchange type cooling apparatus for a transformer capable of having a light weight and exhibiting a low energy and high efficiency cooling performance.

2. Description of the Related Art

As a capacity of a transformer increases, a heat generation amount increases and a temperature rise becomes large, such that a problem occurs in a voltage transformation efficiency. Therefore, the transformer is filled with a transformer oil so as to prevent a temperature rise due to Joule heat flowing in a coil and is operated at a predetermined temperature by cooling the transformer oil. The transformer oil, which is an insulating oil obtained by fractionalizing and purifying mineral oil, is used for insulation and cooling of the transformer.

A cooling system for the transformer has used several cooling schemes such as a dry self-cooling scheme, a dry wind cooling scheme, an oil-filled self-cooling scheme, an oil-filled wind cooling scheme, an oil-filled water cooling scheme, an oil-filled air cooling scheme, and the like, depending on a capacity thereof.

Among them, the oil-filled self-cooling scheme is a scheme of putting a transformer body in a case in which the transformer oil is fully filled, transferring a heat generated in an iron core and a winding to the case by a convection action of the transformer oil, and dissipating heat to the air by a radiation and a convection in the case, the oil-filled wind cooling scheme, which is a scheme of obtaining a cooling effect by attaching a blower to an oil filled transformer to which a radiator is attached to perform a forced draft, is used in a large capacity transformer, and the oil-filled water cooling scheme is a scheme of cooling the transformer by installing a cooling pipe for an upper insulating oil in the case of the transformer and circulating a cooling water.

Meanwhile, various electric trains include a transformer for supplying a power to a driving motor. The transformer in operation generates a significant heat. Various cooling systems may be applied in order to cool the transformers. However, in the case of a blowing fan scheme that has been mainly used conventionally, a blowing fan having a weight of several hundreds of kilograms is provided to each transformer, such that a weight is excessively heavy and a large installation space is also required. In addition, an energy for operating the blowing fan also has an effect on the entire efficiency.

In addition to the above-mentioned cooling systems, Korean Patent Laid-Opened Publication No. 10-2005-0108508 has disclosed an oil forced cooling apparatus for a transformer using a heat exchange scheme, but does not suggest a circulation pump and a heat exchanger capable of being applied to a field having large vibrations. In addition, since the oil forced cooling apparatus for a transformer disclosed in Korean Patent Laid-Opened Publication No. 10-2005-0108508 includes a compressor and an evaporator for a cooling cycle, an energy efficiency is low.

Korean Patent Laid-Opened Publication No. 10-2007-0075970. has disclosed a cooling apparatus for a transformer using a cooling cycle without a compressor. However, the cooling apparatus disclosed in Korean Patent Laid-Opened Publication No. 10-2007-0075970 uses a liquefied gas based refrigerant having a boiling point less than 95° C. and still includes an evaporator. Therefore, there is a limitation in making the cooling apparatus compact and saving an energy, and does not consider a structure of a heat exchanger capable of improving a cooling performance or a lightness structure.

SUMMARY

An object of the present disclosure is to provide to a heat exchange type cooling system for a transformer capable of being fabricated at a light weight and a small size, saving an energy, and having a high durability to a noise or a vibration and a high efficiency cooling performance.

According to an exemplary embodiment of the present disclosure, there is provided a heat exchange type cooling apparatus for a transformer, including: an insulating oil circulation pipe configured in a closed circuit form so that an insulating oil filled in the transformer is discharged to the outside and then returns again to the transformer; an insulating oil pump configured to transfer the insulating oil; and an insulating oil cooling system configured to cool the insulating oil, wherein the insulating oil cooling system includes: a liquid refrigerant maintained in a liquid state during the entire circulation cycle; a refrigerant circulation pipe configured to circulate the liquid refrigerant; a refrigerant pump configured to transfer the liquid refrigerant; and a heat exchanging part configured to heat-exchange the liquid refrigerant and the insulating oil with each other to cool the insulating oil, the heat exchanging part including: a multi-layer channel part including a plurality of layers formed so that the insulating oil flows onto the plurality of layers; an inlet part disposed at an upper portion of the multi-layer channel part; an outlet part disposed at a lower portion of the multi-layer channel part; and a refrigerant casing part configured to enclose the multi-layer channel part and configured so that the liquid refrigerant flows around multi-layer channel part.

The liquid refrigerant may have a boiling point of 120° C. or more. The liquid refrigerant may include ethylene glycol (EG).

The multi-layer channel part, the inlet part, the outlet part, and the refrigerant casing part may be made of a stainless steel.

The respective channel parts forming the multi-layer channel part may be formed by bending a metal thin plate in a rectangular shape.

The metal thin plate may have a thickness t of 0.4 to 0.8 mm.

The respective channel parts may have a rectangular cross section and have an inner side short width h of 1.8 to 2.2 mm and an inner side long width w of 80 to 120 mm.

The multi-layer channel part may include a first multi-layer channel part and a second multi-layer channel part disposed to be spaced apart from each other by a predetermined horizontal distance.

The inlet part may include a guide plate branching a flow channel into a plurality of parts so that the insulating oil is uniformly supplied to the multi-channel part.

The heat exchange type cooling apparatus for a transformer may further include a controlling plate configured to control a set cooling temperature of the heat exchanging part to be higher in the summer than in the winter.

The refrigerant pump may include a motor part and an impeller part transferring the refrigerant by the motor part, and the refrigerant may be configured to be circulated to an inner portion of the motor part.

The insulating oil circulation pipe, the insulating oil pump, and the insulating oil cooling system may include: a first insulating oil circulation pipe, a first insulating oil pump transferring an insulating oil in the first insulating oil circulation pipe, and a first insulating oil cooling system cooling the insulating oil in the first insulating oil circulation pipe, which are disposed at one side of one transformer; and a second insulating oil circulation pipe, a second insulating oil pump transferring an insulating oil in the second insulating oil circulation pipe at the time of an emergency, and a second insulating oil cooling system cooling the insulating oil in the second insulating oil circulation pipe, which are disposed at the other side of one transformer.

DETAILED DESCRIPTION

Hereinafter, a heat exchange type cooling apparatus for a transformer according to exemplary embodiments of the present disclosure will be described in detail with reference to the accompanying drawings.

Figure 1:
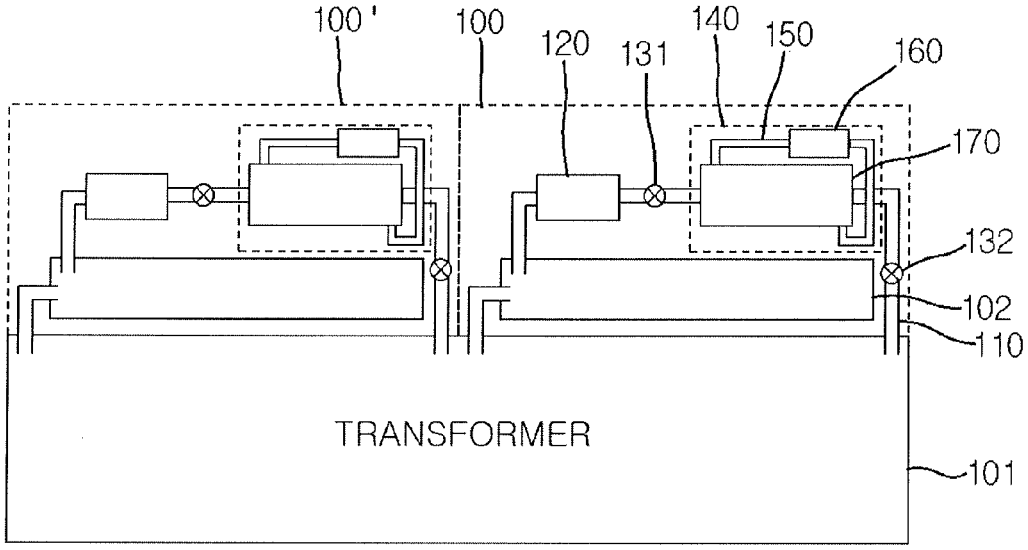
FIG. 1 is a conceptual diagram of a cooling system for a transformer to which heat exchange type cooling apparatuses 100 and 100' for a transformer according to an exemplary embodiment of the present disclosure are applied.

FIG. 1 is a conceptual diagram of a cooling system for a transformer to which heat exchange type cooling apparatuses 100 and 100' for a transformer according to an exemplary embodiment of the present disclosure are applied.

As shown in FIG. 1, the heat exchange type cooling apparatuses 100 and 100' for a transformer according to the exemplary embodiment of the present disclosure are configured so that an insulating oil filled in a transformer 101 may dissipate Joule heat generated by coils in the transformer 101 to the outside while being circulated. To this end, one side of the transformer 101 is provided with a tank 102 for supplying the insulating oil, which is cooled while being circulated by various pumps, or the like, to be described below and then returns into the transformer 101. Here, the heat exchange type cooling apparatus for a transformer according to the exemplary embodiment of the present disclosure does not include a component such as a blower or a fan that has a heavy weight or uses a large amount of energy and has implemented a light weight, a small size, a low energy, and a high-efficiency cooling by a heat exchanger.

As shown in FIG. 1, the heat exchange type cooling apparatus for a transformer may be provided with one heat exchange type cooling apparatus 100 for a transformer and the other heat exchange type cooling apparatus 100' for a transformer so as to ensure an operation of the transformer 101 even at the time of a fault or an emergency. That is, any one of the heat exchange type cooling apparatuses for a transformer is operated at the ordinary time, and the other of the heat exchange type cooling apparatuses for a transformer is operated in a situation such as a maintenance situation, or the like, to allow the cooling of the transformer 101 not to be stopped.

The heat exchange type cooling apparatus 100 for a transformer may generally include an insulating oil circulation pipe 110, an insulating oil pump 120, various valves 131 and 132, and an insulating oil cooling system 140.

The insulating oil circulation pipe 110 is configured in a closed circuit form so that the insulating oil filled in the transformer 101 may be discharged to the outside and then return again to the transformer 101.

The insulating oil pump 120, which is configured to transfer the insulating oil by a power, may include a motor pump, or the like. As the insulating oil pump 120, a pump capable of being operated at a low speed according to improvement in a performance of a heat exchanging part to be described below, may be adopted, and a four-pole motor pump of which a revolution per minute (PRM) is about 1,800 may be used. In this case, since the RPM is low, a noise and a vibration may be significantly decreased, a lifespan of a bearing may be increased, and a cost required for repair and management due to a frequent fault may be saved.

The insulating oil cooling system 140 may use a liquid refrigerant that needs not to be compressed or condensed. That is, the refrigerant used in the heat exchange type cooling apparatus for a transformer according to the exemplary embodiment of the present disclosure, which is a liquid refrigerant having a high boiling point, is maintained in a liquid state during the entire circulation cycle. As the liquid refrigerant, which may effectively dissipate a heat energy of the insulating oil while being maintained in a liquid state even at a temperature equal to or higher than a temperature at which a thermal denaturation of the insulating oil may occur, a material having a boiling point of 120° C. or more may be used. In the present embodiment, ethylene glycol (EG) has been used as the liquid refrigerant. The ethylene glycol, which is a material having a freezing point low enough to be used in a anti-freezing liquid but having a high boiling point, effectively implements a cooling action of the insulating oil without a phase change during a cycle. As a result, since a compressor and a condenser are not used, an increase in a cost and a weight for configuring the compressor and the condenser, an increase in an operation energy, an increase in a maintenance situation, an increase in an installation area, and the like, are not fundamentally generated.

The insulating oil cooling system 140 may include the liquid refrigerant maintained in the liquid state for the entire circulation cycle as described above, a refrigerant circulation pipe 150 circulating the liquid refrigerant, a refrigerant pump 160 configured to transfer the liquid refrigerant, and a heat exchanging part 170 heat-exchanging the insulating oil and the liquid refrigerant with each other to cool the insulating oil.

Figure 2:
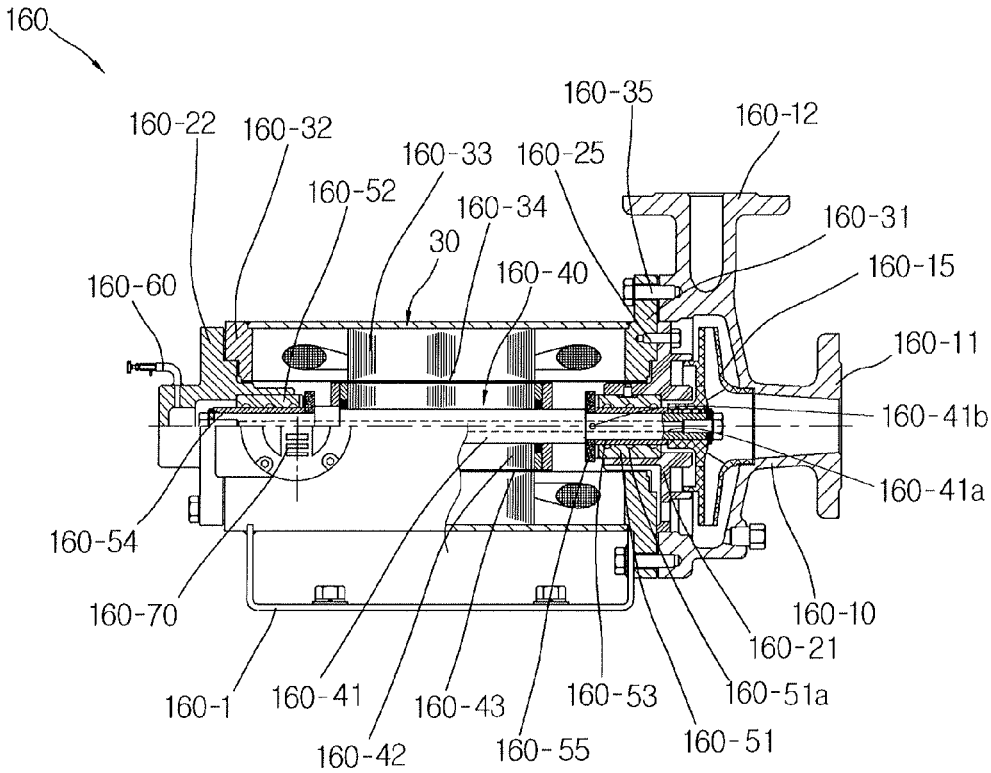
FIG. 2 is a cross-sectional view of a refrigerant pump 160 according to the exemplary embodiment of the present disclosure.

FIG. 2 is a cross-sectional view of a refrigerant pump 160 according to the exemplary embodiment of the present disclosure. As the refrigerant pump 160 according to the present embodiment, which is a high heat resistance pump capable of resisting a high temperature, a non-sealed canned motor pump in which a seal ring is not damaged even in an excessive vibration environment such as an electric train, or the like, may be used. That is, the refrigerant pump 160 may include a motor part and an impeller part, and the refrigerant is configured to be circulated to an inner portion of the motor part. Next, the refrigerant pump 160 will be described in more detail.

The refrigerant pump 160 may include components such as a casing 160-10, an impeller 160-15, a front housing 160-12, a rear housing 160-22, a stator unit 160-30, a rotor assembly 160-40, bearings 160-51 and 160-52, sleeves 160-55 and 160-56, an auxiliary impeller 160-60, a connector 160-70, and the like. However, in some cases, the refrigerant pump 160 does not include some of the above-mentioned components or may be replaced in another form.

The casing 160-10, which is a component enclosing the impeller 160-15, is provided with an inlet 111 to which an operating fluid, that is, the liquid refrigerant is input and an outlet 112 transferring the operating fluid by a centrifugal force.

The impeller 160-15, which is a component coupled to the rotor assembly 160-40, receives a driving force provided from the rotor assembly 160-40 and forcibly guides the operating fluid in a centrifugal direction by rotation to allow the operating fluid to move toward the outlet 112 of the casing 160-10.

The front housing 160-21 and the rear housing 160-22 are formed in a form in which they are extended inwardly, respectively, so as to provide seats on which the bearings 160-51 and 160-52 are to be seated. In order to couple the front housing 160-21 and the rear housing 160-22 to each other, the stator unit 160-30 is provided with the respective flanges 160-31 and 160-32. Here, the front flange 131 may be formed in a form in which it has a diameter larger than that of the rear flange 132 so as to be directly coupled to the casing 160-10. The front flange 131 and the casing 160-10 are coupled to each other by a flange bolt 135 inserted from the front flange 131 side. A high sealing force may be obtained and the assembling may be simplified by a direct coupling structure between the stator unit 160-30 and the casing 160-10. The front housing 160-21 is coupled to the front flange 131 of the stator unit 160-30 by a flange bolt 125 inserted from the front housing 160-21 side.

The rotor assembly 160-40 includes a shaft 160-41, a rotor core 160-42 fixed to the shaft 160-41, and a rotor can 143 sealing the rotor core 160-42.

The shaft 160-41 includes a through-hole 160-41*a* formed in a length direction at the center thereof and includes a side hole 160-41*b* connected to the through-hole 160-41*a* and formed in a radial direction. When the motor is operated, the operating fluid is introduced into through the through-hole 160-41*a* by an action of the impeller 160-15 and is then introduced into an internal space of the motor through the side hole 160-41*b*.

A front end and a rear end of the rotor assembly 160-40 are fitted by the sleeves 160-53 and 160-54, respectively, and the sleeves 160-53 and 160-54 are supported by the respective bearings 160-51 and 160-52. The bearings 160-51 and 160-52 include a labyrinth 160-51*a* formed in spiral and axial directions, and smooth sliding between the shaft 160-41 and the bearings 160-51 and 160-52 is generated by the operating fluid moved along the labyrinth 160-51*a*. Therefore, a lubricating action is implemented by the liquid refrigerant, which is the operating fluid transferred by a pump, without using a separate lubricating oil. Therefore, since a seal ring, or the like, is not used for a period in which the refrigerant pump 160 is operated, leakage of the refrigerant due to breakage of the seal ring does not occur.

The stator unit 160-30 has a form in which an electric wire is wound around an iron core 160-33 and is sealed by a stator can 160-34. A front end portion and a rear end portion of the stator unit 160-30 are provided with the flanges 160-31 and 160-32 so as to be coupled to the front housing 160-21 and the rear housing 160-32, respectively, as described above.

The auxiliary impeller 160-60 provides a passage for discharging an air included in an internal space in which the rotor assembly 160-40 is mounted. That is, the auxiliary impeller 160-60 discharges the air so that the operating fluid is introduced into the internal space by rotation of the impeller 160-15 after the heat exchange type cooling apparatus for a transformer is operated and is closed when the air is completely discharged.

The connector 160-70, which is a component connecting the electric wire, or the like, of the stator unit 160-30 to an external terminal, is spaced apart from a high temperature stator unit 160-30 by a predetermined distance by an extension tube.

As described above, since the liquid refrigerant is introduced and circulated into the refrigerant pump 160 formed in the non-sealed canned motor pump to implement a cooling action and a lubricating action of the motor part of the refrigerant pump 160 without having an effect on an internal component of the motor part, the seal ring may not be damaged and durability may be increased.

Figure 3:
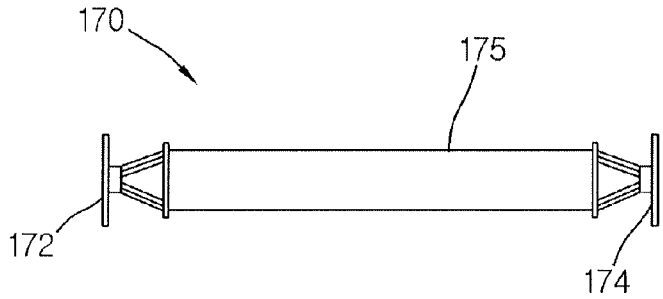
FIG. 3 is a side view of a heat exchanging part 170 according to the exemplary embodiment of the present disclosure.
Figure 4:
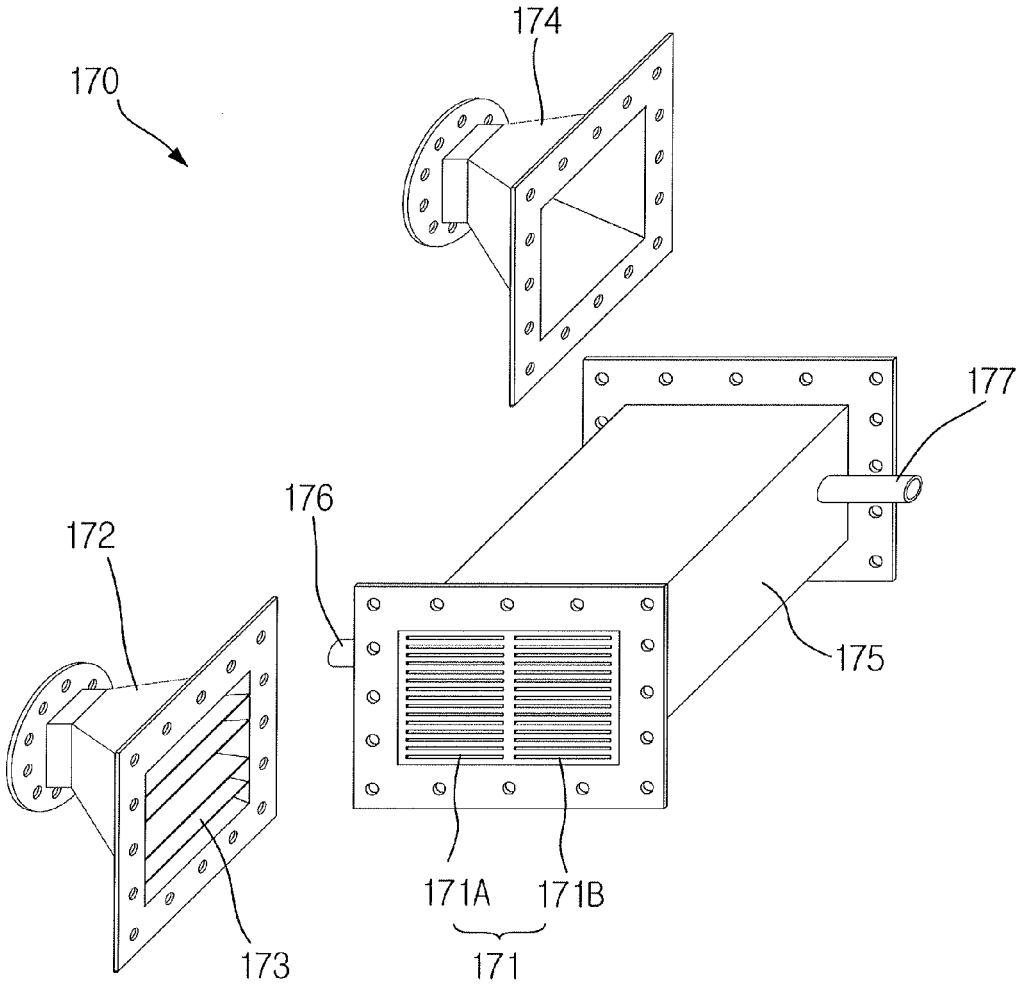
FIG. 4 is an exploded perspective view of the heat exchanging part 170 according to the exemplary embodiment of the present disclosure.
Figure 5:
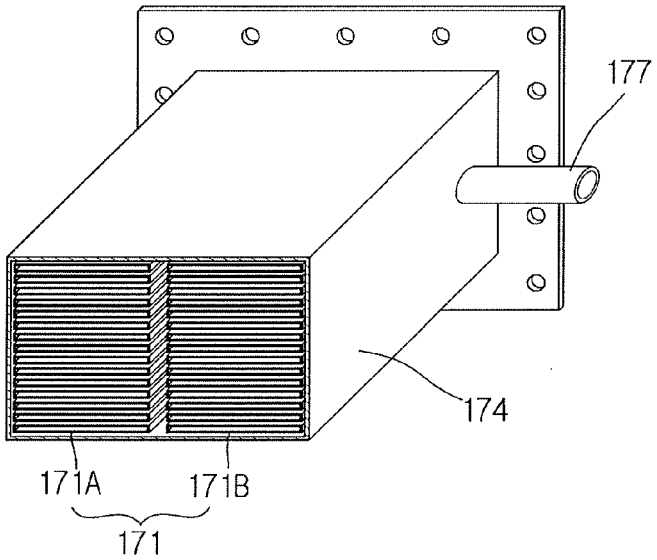
FIG. 5 is a partial cross-sectional perspective view of the heat exchanging part 170 according to the exemplary embodiment of the present disclosure.
Figure 6:
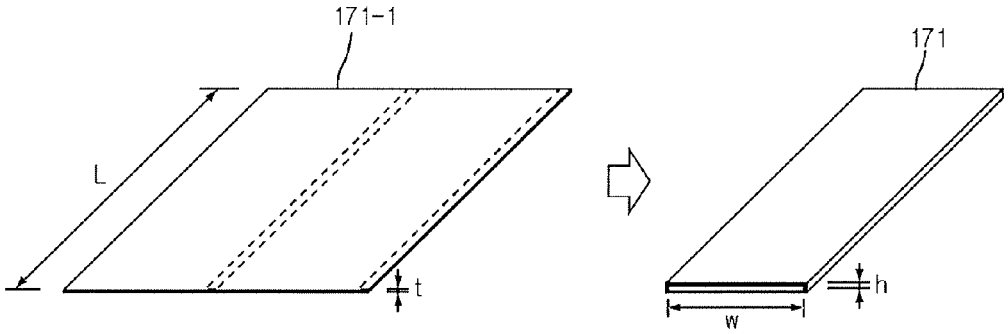
FIG. 6 is a conceptual diagram showing a method of fabricating a multi-layer channel part 171 according to the exemplary embodiment of the present disclosure.

FIG. 3 is a side view of a heat exchanging part 170 according to the exemplary embodiment of the present disclosure; FIG. 4 is an exploded perspective view of the heat exchanging part 170 according to the exemplary embodiment of the present disclosure; FIG. 5 is a partial cross-sectional perspective view of the heat exchanging part 170 according to the exemplary embodiment of the present disclosure; and FIG. 6 is a conceptual diagram showing a method of fabricating a multi-layer channel part 171 according to the exemplary embodiment of the present disclosure.

As shown in FIGS. 3 to 6, the heat exchanging part 170, which is configured to transfer a heat of the insulating oil to the liquid refrigerant in a state in which the insulating oil and the liquid refrigerant are allowed to independently flow, has been fabricated in a form in which it has a light weight and a long lifespan.

The heat exchanging part 170 includes a multi-layer channel part 171 including a plurality of layers formed so that the insulating oil may flow onto the plurality of layers, an inlet part 172 disposed at an upper portion of the multi-layer channel part 171, an outlet part 173 disposed at a lower portion of the multi-layer channel part 171, and a refrigerant casing part 174 configured to enclose the multi-layer channel part 171 and configured so that the liquid refrigerant may flow around multi-layer channel part 171. The multi-layer channel part 171, the inlet part 172, the outlet part 173, and the refrigerant casing part 174 may be made of a metal thin plate capable of decreasing a weight and having a corrosion resistance. A specific example of the metal thin plate may include a stainless steel.

The multi-layer channel part 171, which is a main component allowing the insulating oil to secure a maximum contact area while flowing to several parts, is preferably configured to have a predetermined rigidity and a wide surface area in spite of a light weight. As shown in FIG. 5, the multi-layer channel part 171 may include a first multi-layer channel part 171A and a second multi-layer channel part 171B disposed to be spaced apart from each other, wherein the first and second multi-layer channel parts 171A and 171B have channel parts stacked to be spaced apart from each other. As shown in FIG. 6, the multi-layer channel part 171 is formed by bending a stainless steel thin plate 171-1 having a thin thickness in a rectangular shape and then sealing portions meeting each other by welding.

In order to provide a surface area enough for heat exchange and a structural rigidity, a thickness t, an inner side short width h, and an inner side long width w of the stainless steel thin plate 171-1 may be limited. That is, the stainless steel thin plate 171-1 having a thickness t of 0.4 to 0.8 mm, an inner side short width h of 1.8 to 2.2 mm, and an inner side long width w of 80 to 120 mm has been used. A length L may be controlled depending on an amount of insulating oil or a scale of the transformer.

The rectangular multi-layer channel part 171 having a thin width and thickness has a heat exchange efficiency significantly more excellent as compared with the case in which the heat exchanger is configured using a circular pipe, or the like, and may make a flow of insulating oil flowing therein smooth and increase a density of the apparatus. Therefore, the rectangular multi-layer channel part may have a light weight and be fabricated at a small size.

The inlet part 172 is provided with a guide plate 173 branching a flow channel into a plurality of parts so that the insulating oil may be uniformly supplied to the multi-channel part 171. The guide plate 173 may be configured so as to be widened in a predetermined inclined form according to a shape in which it is expanded from the refrigerant circulation pipe 150 to the heat exchanging part 170.

Figure 7:
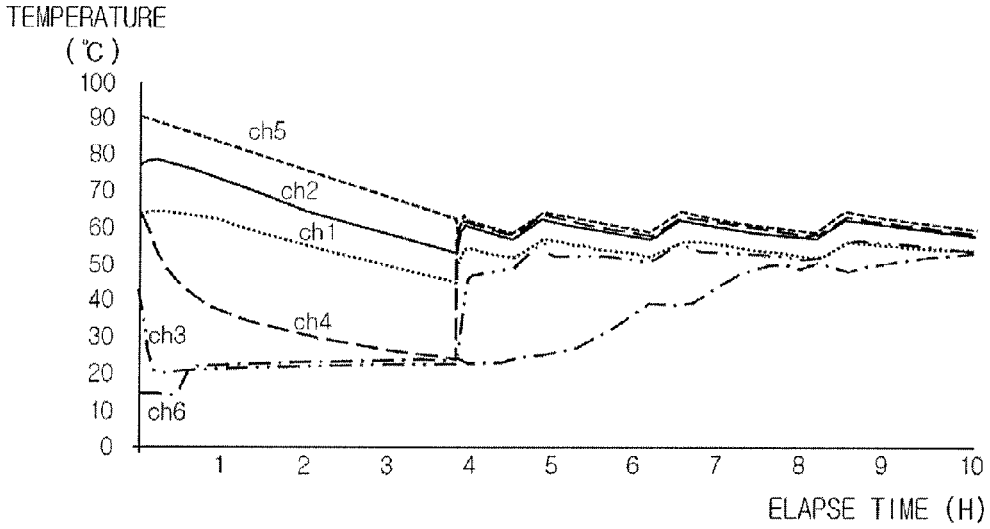
FIG. 7 is a graph showing a test result of a cooling performance by the heat exchange type cooling apparatus for a transformer according to the exemplary embodiment of the present disclosure.

FIG. 7 is a graph showing a test result of a cooling performance by the heat exchange type cooling apparatus for a transformer according to the exemplary embodiment of the present disclosure. In FIG. 7, ch1 indicates an external temperature of the insulating oil pump, ch2 indicates an internal temperature of the insulating oil pump, ch3 indicates a temperature of a front portion of the heat exchanging part, ch4 indicates a temperature of a rear portion of the heat exchanging part, ch5 indicates a temperature of the insulating oil tank, and ch6 indicates a temperature of the refrigerant tank.

After the heat exchange type cooling apparatus for a transformer according to the exemplary embodiment of the present disclosure is configured, in an initial state, the temperature ch5 of the insulating oil was 90.6° C. and the temperature ch6 of the refrigerant is 14.6° C. As an absolute time elapses after an operation starts, the temperatures at these portions were measured every thirty seconds. It could be confirmed that the temperature of the insulating oil is rapidly decreased with the passage of time.

After heating was performed at a predetermined time (in consideration of generation of heat due to an operation of the transformer), a temperature change according to the heating was continuously recorded. It could be seen that although a temperature of the insulating oil is increased according to the heating, as a time elapses, a temperature lower than an initial temperature by about 30° C. is constantly maintained, and although a temperature of the refrigerant is increased as compared with an initial temperature, it is maintained at about 54° C. The liquid refrigerant of which the temperature is increased may be cooled by an ambient air introduced into a train, or the like, that is being driven.

As described above, since the heat exchange type cooling apparatus for a transformer according to the exemplary embodiment of the present disclosure may have an excellent heat exchange efficiency, overcome a problem due to an existing large-sized insulating oil cooling system using a blowing fan, or the like, may not cause leakage since it does not use a seal ring in an electric train in which there are always vibrations, and may implement a high heat exchange performance, applicability thereof is excellent.

In addition, the heat exchange type cooling apparatus for a transformer according to the exemplary embodiment of the present disclosure may include a controlling plate or a controller configured to control a set cooling temperature of the heat exchanging part, for example, a cooling temperature of the insulating oil to be higher in the summer than in the winter. Since the controller may easily control the cooling temperature required for an operation of the transformer depending on a season or an operation zone of the transformer, an efficiency may be excellent and an energy may be further saved.

As set forth above, with the heat exchange type cooling apparatus for a transformer according to the exemplary embodiment of the present disclosure, since the insulating oil is cooled by the heat exchanging part fabricated in a multi-layer form and the liquid refrigerant maintained in a liquid state during the entire circulation cycle, a weight may be significantly decreased as compared with an existing cooling system in which a separate blowing fan is installed for cooling. In addition, since a compressor, a condenser, a motor for rotating a fan, and the like, are not required, a cost and an energy may be saved.

Since the heat exchange type cooling apparatus for a transformer according to the exemplary embodiment of the present disclosure may maintain sealing even in a vibration or high temperature environment by using a canned motor type corresponding to a structure in which the refrigerant is circulated in the refrigerant pump, it may be widely applied to a high speed electric train or a high vibration industrial field.

The heat exchange type cooling apparatus for a transformer as described above are not restrictively applied to the configuration and the method of the exemplary embodiments described above. All or some of the above-mentioned exemplary embodiments may also be selectively combined with each other so that various modifications may be made.

What is claimed is:

1. A heat exchange type cooling apparatus for a transformer, comprising:

an insulating oil circulation pipe configured in a closed circuit form so that an insulating oil filled in the transformer is discharged to the outside and then returns again to the transformer;

an insulating oil pump configured to transfer the insulating oil; and an insulating oil cooling system configured to cool the insulating oil, wherein the insulating oil cooling system includes:

a liquid refrigerant maintained in a liquid state during the entire circulation cycle;

a refrigerant circulation pipe configured to circulate the liquid refrigerant;

a refrigerant pump configured to transfer the liquid refrigerant; and a heat exchanging part configured to heat-exchange the liquid refrigerant and the insulating oil with each other to cool the insulating oil, the heat exchanging part including:

a multi-layer channel part including a plurality of layers formed so that the insulating oil flows onto the plurality of layers;

an inlet part disposed at an upper portion of the multi-layer channel part;

an outlet part disposed at a lower portion of the multi-layer channel part; and a refrigerant casing part configured to enclose the multi-layer channel part and configured so that the liquid refrigerant flows around multi-layer channel part.

2. The heat exchange type cooling apparatus for a transformer of claim 1, wherein the liquid refrigerant has a boiling point of 120° C. or more.

3. The heat exchange type cooling apparatus for a transformer of claim 1, wherein the liquid refrigerant includes ethylene glycol (EG).

4. The heat exchange type cooling apparatus for a transformer of claim 1, wherein the multi-layer channel part, the inlet part, the outlet part, and the refrigerant casing part are made of a stainless steel.

5. The heat exchange type cooling apparatus for a transformer of claim 1, wherein the respective channel parts forming the multi-layer channel part are formed by bending a metal thin plate in a rectangular shape.

6. The heat exchange type cooling apparatus for a transformer of claim 5, wherein the metal thin plate has a thickness t of 0.4 to 0.8 mm.

7. The heat exchange type cooling apparatus for a transformer of claim 5, wherein the respective channel parts have a rectangular cross section and have an inner side short width h of 1.8 to 2.2 mm and an inner side long width w of 80 to 120 mm.

8. The heat exchange type cooling apparatus for a transformer of claim 7, wherein the multi-layer channel part includes a first multi-layer channel part and a second multi-layer channel part disposed to be spaced apart from each other by a predetermined horizontal distance.

9. The heat exchange type cooling apparatus for a transformer of claim 1, wherein the inlet part includes a guide plate branching a flow channel into a plurality of parts so that the insulating oil is uniformly supplied to the multi-channel part.

10. The heat exchange type cooling apparatus for a transformer of claim 1, further comprising a controlling plate configured to control a set cooling temperature of the heat exchanging part to be higher in the summer than in the winter.

11. The heat exchange type cooling apparatus for a transformer of claim 1, wherein the refrigerant pump includes a motor part and an impeller part transferring the refrigerant by the motor part, and the refrigerant is configured to be circulated to an inner portion of the motor part.

12. The heat exchange type cooling apparatus for a transformer of claim 1, wherein the insulating oil circulation pipe, the insulating oil pump, and the insulating oil cooling system include:

a first insulating oil circulation pipe, a first insulating oil pump transferring an insulating oil in the first insulating oil circulation pipe, and a first insulating oil cooling system cooling the insulating oil in the first insulating oil circulation pipe, which are disposed at one side of one transformer; and a second insulating oil circulation pipe, a second insulating oil pump transferring an insulating oil in the second insulating oil circulation pipe at the time of an emergency, and a second insulating oil cooling system cooling the insulating oil in the second insulating oil circulation pipe, which are disposed at the other side of one transformer.

* * * * *